US005108881A

United States Patent [19]

Dickerson et al.

[11] Patent Number: 5,108,881

[45] Date of Patent: * Apr. 28, 1992

[54] MINIMAL CROSSOVER RADIOGRAPHIC ELEMENTS ADAPTED FOR VARIED INTENSIFYING SCREEN EXPOSURES

[75] Inventors: Robert E. Dickerson, Rochester; Phillip C. Bunch, Brighton, both of N.Y.

[73] Assignee: Eastman Kodak Company, Rochester, N.Y.

[ * ] Notice: The portion of the term of this patent subsequent to Feb. 19, 2008 has been disclaimed.

[21] Appl. No.: 502,153

[22] Filed: Mar. 29, 1990

[51] Int. Cl.[5] ..... G03C 1/46

[52] U.S. Cl. ..... 430/502; 430/966; 430/509

[58] Field of Search ..... 430/502, 966, 509

[56] References Cited

U.S. PATENT DOCUMENTS 4,425,425 1/1984 Abbott et al. ..... 430/502
4,425,426 1/1984 Abbott et al. ..... 430/502
4,803,150 2/1989 Dickerson et al. ..... 430/502
4,900,652 2/1990 Dickerson et al. ..... 430/502
4,994,355 2/1991 Dickerson et al. ..... 430/509

FOREIGN PATENT DOCUMENTS 276497 8/1988 European Pat. Off. .

*Primary Examiner*—Charles L. Bowers, Jr.
*Assistant Examiner*—Janet C. Baker
*Attorney, Agent, or Firm*—Carl O. Thomas

[57] ABSTRACT

Radiographic elements are disclosed with silver halide emulsion layer units coated on opposite sides of a film support. The radiographic elements are constructed to reduce crossover during exposure by intensifying screens to minimal levels. To permit the minimal crossover radiographic elements to be employed with varied intensifying screens, one of the silver halide emulsion layer units over an exposure range of at least 1.0 log E exhibits an average contrast of from 0.5 to <2.0 and point gammas that differ from the average contrast by less than ±40% and the second silver halide emulsion layer unit exhibits a mid-scale contrast of at least 0.5 greater than the average contrast of the first silvert halide emulsion layer unit.

9 Claims, 8 Drawing Sheets

MINIMAL CROSSOVER RADIOGRAPHIC ELEMENTS ADAPTED FOR VARIED INTENSIFYING SCREEN EXPOSURES

FIELD OF THE DISCLOSURE

The invention relates to radiographic imaging. More specifically, the invention relates to double coated silver halide radiographic elements of the type employed in combination with intensifying screens.

BACKGROUND

In medical radiography an image of a patient's tissue and bone structure is produced by exposing the patient to X-radiation and recording the pattern of penetrating X-radiation using a radiographic element containing at least one radiation-sensitive silver halide emulsion layer coated on a transparent (usually blue tinted) film support. The X-radiation can be directly recorded by the emulsion layer where only limited areas of exposure are required, as in dental imaging and the imaging of body extremities. However, a more efficient approach, which greatly reduces X-radiation exposures, is to employ an intensifying screen in combination with the radiographic element. The intensifying screen absorbs X-radiation and emits longer wavelength electromagnetic radiation which silver halide emulsions more readily absorb. Another technique for reducing patient exposure is to coat two silver halide emulsion layers on opposite sides of the film support to form a "double coated" radiographic element.

Diagnostic needs can be satisfied at the lowest patient X-radiation exposure levels by employing a double coated radiographic element in combination with a pair of intensifying screens. The silver halide emulsion layer unit on each side of the support directly absorbs about 1 to 2 percent of incident X-radiation. The front screen, the screen nearest the X-radiation source, absorbs a much higher percentage of X-radiation, but still transmits sufficient X-radiation to expose the back screen, the screen farthest from the X-radiation source.

An imagewise exposed double coated radiographic element contains a latent image in each of the two silver halide emulsion units on opposite sides of the film support. Processing converts the latent images to silver images and concurrently fixes out undeveloped silver halide, rendering the film light insensitive. When the film is mounted on a view box, the two superimposed silver images on opposite sides of the support are seen as a single image against a white, illuminated background.

An art recognized difficulty with employing double coated radiographic elements in combination with intensifying screens as described above is that some light emitted by each screen passes through the transparent film support to expose the silver halide emulsion layer unit on the opposite side of the support to light. The light emitted by a screen that exposes the emulsion layer unit on the opposite side of the support reduces image sharpness. The effect is referred to in the art as crossover.

A variety of approaches have been suggested to reduce crossover, as illustrated by *Research Disclosure*, Vol. 184, August 1979, Item 18431, Section V. Cross-Over Exposure Control. *Research Disclosure* is published by Kenneth Mason Publications, Ltd., Dudley Annex, 21a North Street, Emsworth, Hampshire P010 7DQ, England. While some of these approaches are capable of entirely eliminating crossover, they either interfere with (typically entirely prevent) concurrent viewing of the superimposed silver images on opposite sides of the support as a single image, require separation and tedious manual reregistration of the silver images in the course of eliminating the crossover reduction medium, or significantly desensitize the silver halide emulsion. As a result, none of these crossover reduction approaches have come into common usage in the radiographic art. An example of a recent crossover cure teaching of this type is Bollen et al European published patent application 276,497, which interposes a reflective support between the emulsion layer units during imaging.

The most successful approach to crossover reduction yet realized by the art consistent with viewing the superimposed silver images through a transparent film support without manual registration of images has been to employ double coated radiographic elements containing spectrally sensitized high aspect ratio tabular grain emulsions or thin intermediate aspect ratio tabular grain emulsions, illustrated by Abbott et al U.S. Pat. Nos. 4,425,425 and 4,425,426, respectively. Whereas radiographic elements typically exhibited crossover levels of at least 25 percent prior to Abbott et al, Abbott et al provide examples of crossover reductions in the 15 to 22 percent range.

Still more recently Dickerson et al U.S. Pat. No. 4,803,150, hereinafter referred to as Dickerson et al I, has demonstrated that by combining the teachings of Abbott et al with a processing solution decolorizable microcrystalline dye located between at least one of the emulsion layer units and the transparent film support "zero" crossover levels can be realized. Since the technique used to determine crossover, single screen exposure of a double coated radiographic element, cannot distinguish between exposure of the emulsion layer unit on the side of the support remote from the screen caused by crossover and the exposure caused by direct absorption of X-radiation, "zero" crossover radiographic elements in reality embrace radiographic elements with a measured crossover (including direct X-ray absorption) of less than about 5 percent.

Dickerson et al U.S. Pat. No. 4,900,652, hereinafter referred to as Dickerson et al II, adds to the teachings of Dickerson et al I, cited above, specific selections of hydrophilic colloid coating coverages in the emulsion and dye containing layers to allow the "zero" crossover radiographic elements to emerge dry to the touch from a conventional rapid access processor in less than 90 seconds with the crossover reducing microcrystalline dye decolorized.

RELATED PATENT APPLICATIONS

Dickerson and Bunch U.S. Ser. No. 314,341, filed Feb. 23, 1989, now abandoned in favor of U.S. Ser. No. 385,114, filed Jul. 26, 1989, commonly assigned, titled RADIOGRAPHIC ELEMENTS WITH SELECTED SPEED RELATIONSHIPS, now U.S. Pat. No. 4,997,750, discloses low crossover double coated radiographic elements in which the emulsion layer units on opposite sides of the support differ in speed.

Dickerson and Bunch U.S. Ser. No. 314,339, filed Feb. 23, 1989, now abandoned in favor of U.S. Ser. No. 385,128, filed Jul. 26, 1989, of which U.S. Ser. No. 502,220, concurrently filed is a continuation-in-part, commonly assigned, titled RADIOGRAPHIC ELEMENTS WITH SELECTED CONTRAST RELA- TIONSHIPS, now U.S. Pat. No. 4,994,355, discloses low crossover double coated radiographic elements in which the emulsion layer units on opposite sides of the support differ in contrast.

Bunch and Dickerson U.S. Ser. No. 314,023, filed Feb. 23, 1989, abandoned in favor of U.S. Ser. No. 373,720, filed Jun. 29, 1989, which was in turn abandoned in favor of U.S. Ser. No. 456,889, filed Dec. 26, 1989, commonly assigned, titled RADIOGRAPHIC SCREEN/FILM ASSEMBLIES WITH IMPROVED DETECTION QUANTUM EFFICIENCIES, U.S. Pat. No. 5,021,327, discloses low crossover double coated radiographic elements in combination with a pair of intensifying screens, where the back emulsion layer unit-intensifying screen combination exhibits a photicity twice that of the front emulsion layer unit-intensifying screen combination, where photicity is the product of screen emission and emulsion layer unit sensitivity.

Jebo, Twombly, Dickerson and Bunch U.S. Ser. No. 502,341, filed concurrently herewith and commonly assigned, titled ASYMMETRICAL RADIOGRAPHIC ELEMENTS, ASSEMBLIES AND PACKAGES discloses low crossover double coated radiographic elements with emulsion layer units on opposite sides of the support that differ in sensitometric properties. A feature is included for ascertaining which of the emulsion layer units is positioned nearest a source of X-radiation during exposure.

BRIEF SUMMARY OF THE INVENTION

In one aspect, this invention is directed to a radiographic element comprised of a transparent film support, first and second silver halide emulsion layer units coated on opposite sides of the film support, and means for reducing to less than 10 percent crossover of electromagnetic radiation of wavelengths longer than 300 nm capable of forming a latent image in the silver halide emulsion layer units, the crossover reducing means being decolorized in less than 30 seconds during processing of the emulsion layer units. The radiographic element is characterized in that the first silver halide emulsion layer unit over an exposure range of at least 1.0 log E exhibits an average contrast of from 0.5 to $<2.0$ and point gammas that differ from the average contrast by less than $\pm 40\%$ and the second silver halide emulsion layer unit exhibits a mid-scale contrast of at least 0.5 greater than the average contrast of the first silver halide emulsion layer unit. The average contrast of the first silver halide emulsion layer unit is determined with the first silver halide emulsion unit replacing the second silver halide emulsion unit to provide an arrangement with the first silver halide emulsion unit present on both sides of the transparent support, and the mid-scale contrast of the second silver halide emulsion layer unit being determined with the second silver halide emulsion unit replacing the first silver halide emulsion unit to provide an arrangement with the second silver halide emulsion layer unit present on both sides of the transparent support.

Figure 2:
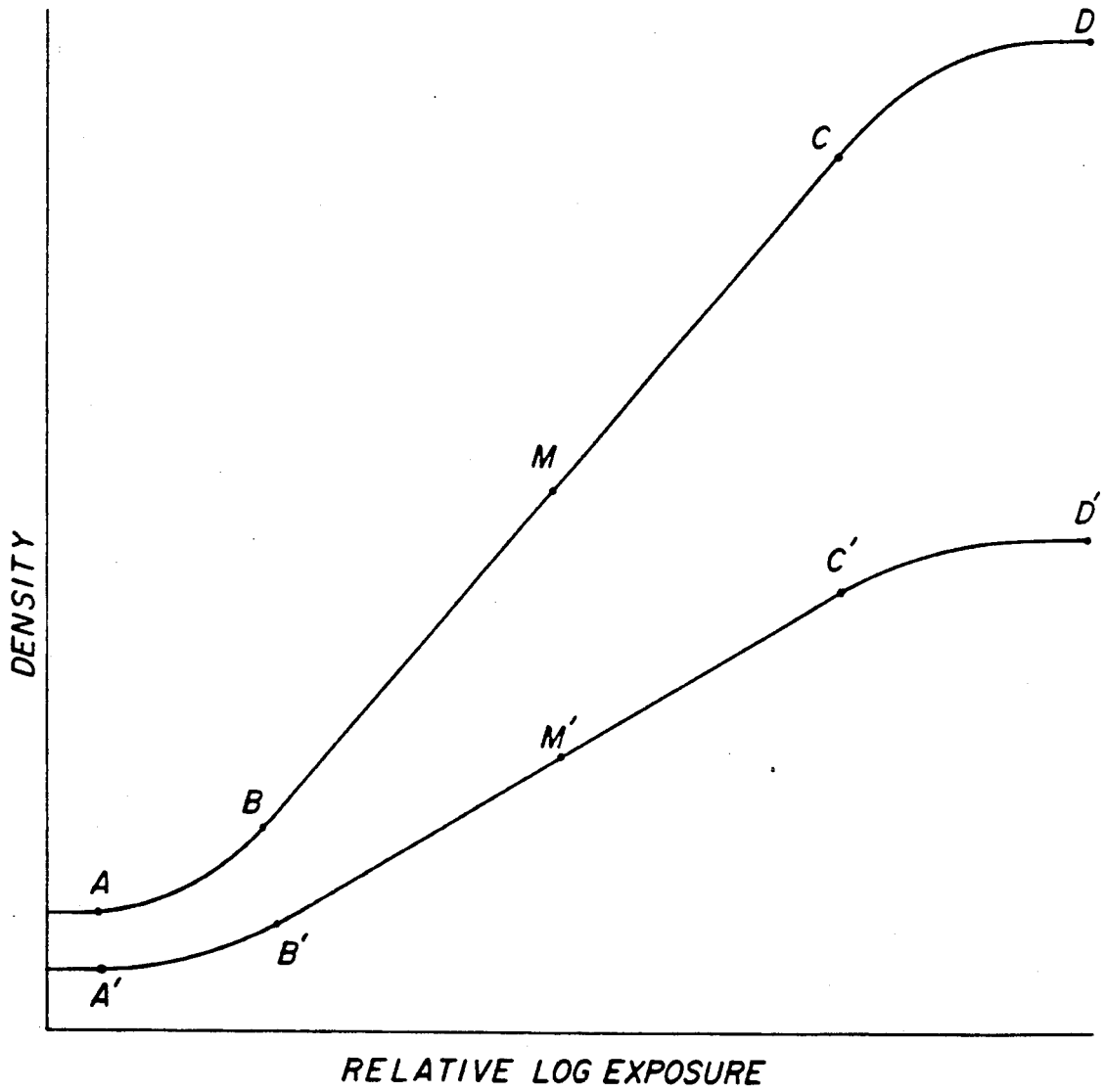
FIG. 2 illustrates the overall sensitometric characteristic curve of a conventional sensitometrically symmetric double coated radiographic element and the characteristic curve of each of two identical individual emulsion layer units forming the radiographic element.
Figure 3:
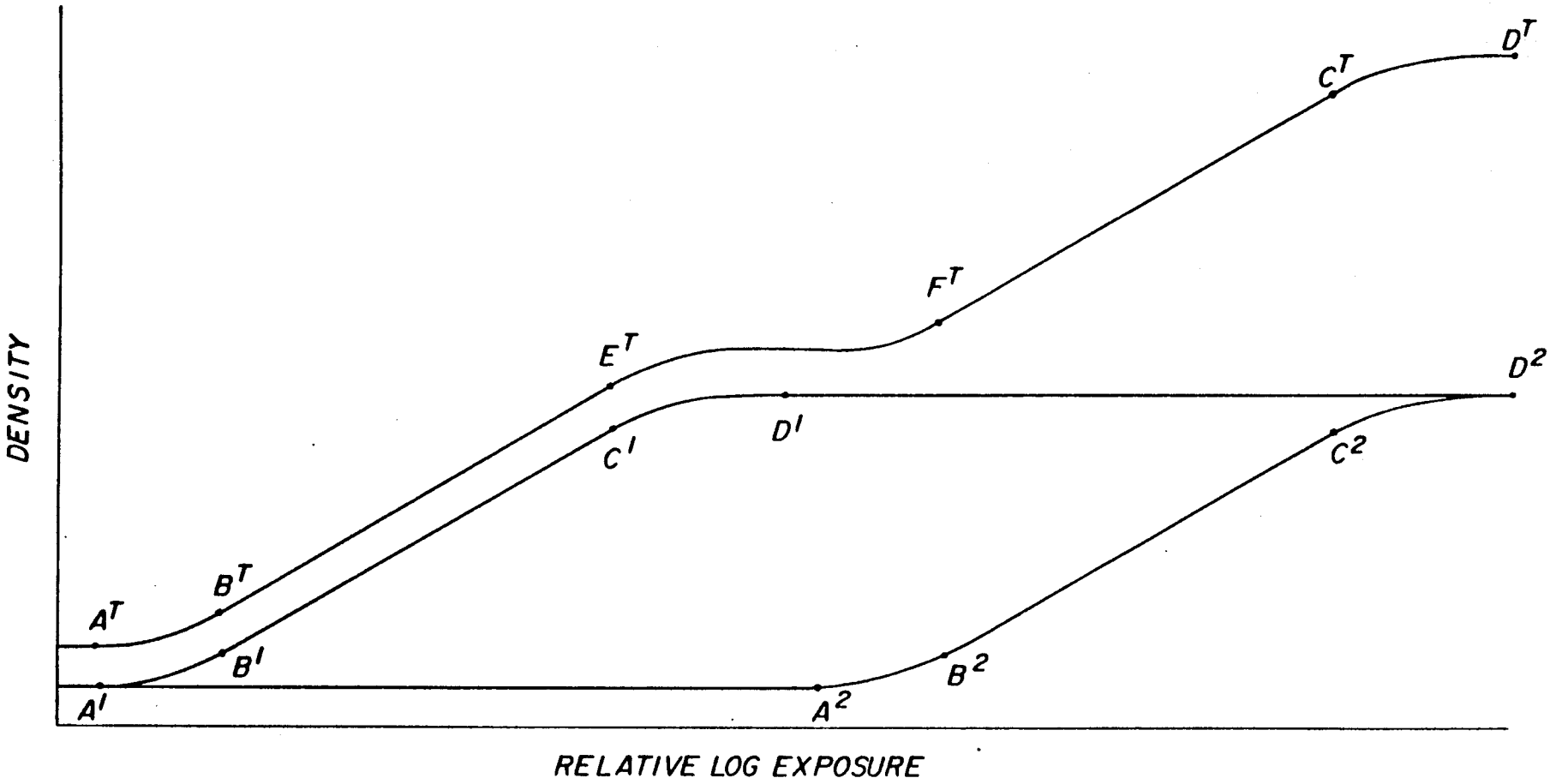
FIG. 3 illustrates the overall sensitometric characteristic curve of a low crossover double coated radiographic element exposed by two intensifying screens of widely varied emission intensities and the characteristic curves of the individual emulsion layer units showing their relative displacement in apparent speed caused by differences in screen emission intensities.
Figure 4:
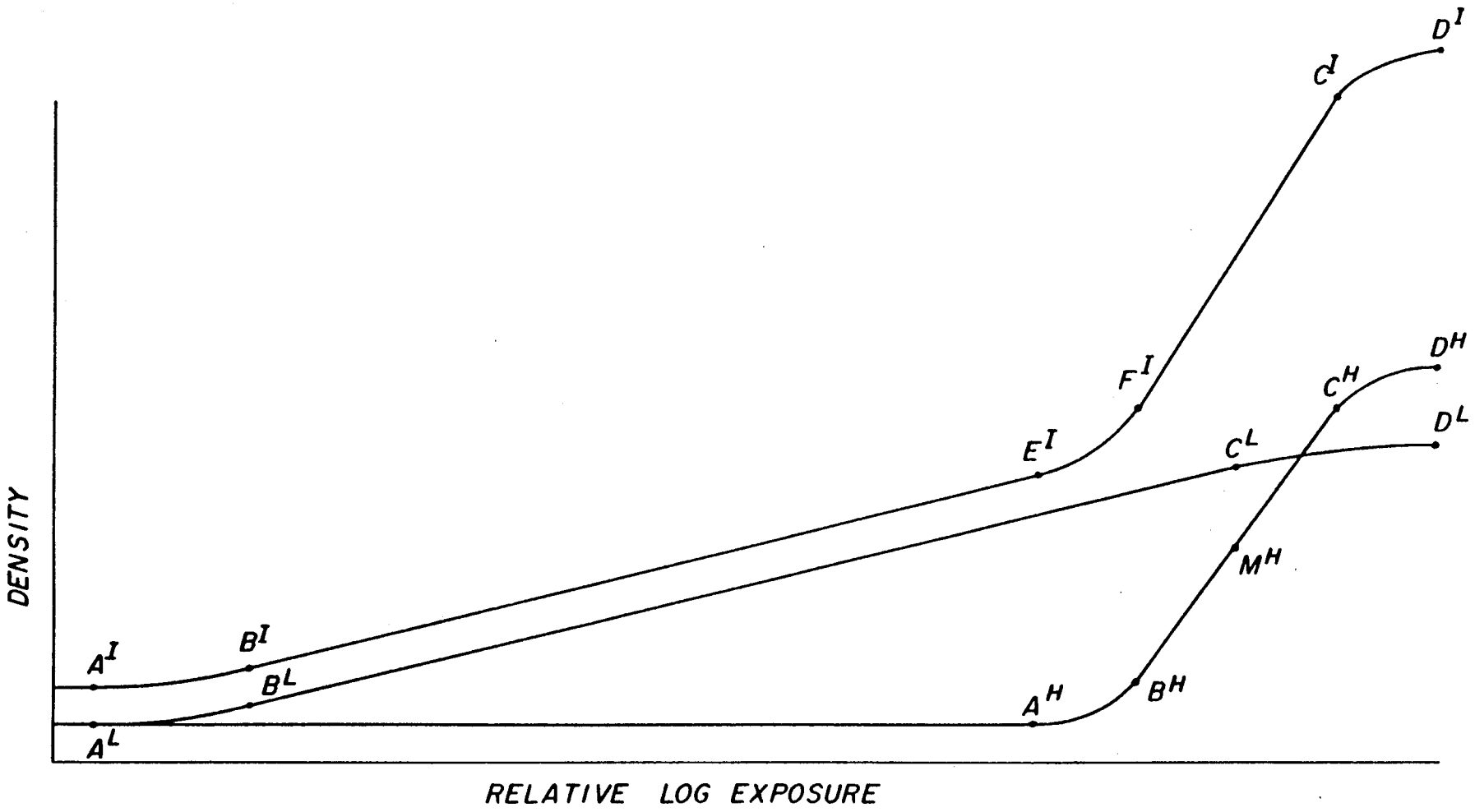
FIG. 4 illustrates the overall sensitometric characteristic curve of a sensitometrically asymmetric low crossover double coated radiographic element according to the invention and the characteristic curves of the individual emulsion layer units as positioned by their screen exposures.

In the characteristic curves of FIGS. 2 to 4 inclusive, presented as aids to visualization of significant features of the prior art and the invention rather than as characteristic curves produced by measurement of actual emulsions, the density of the support, being irrelevant, has been assigned a value of zero and the minimum density of each emulsion layer unit has been exaggerated for ease of visualization. In the example characteristic curves of FIGS. 5 and 7, based on actual measurements, the minimum density shown is almost entirely attributable to the density of the conventional blue tinted transparent film support while the minimum density of the individual emulsion layer units in each instance fell below the limits of plotting accuracy.

SENSITOMETRIC FEATURES

For ease of visualization the characteristic curves of FIGS. 2, 3 and 4 have been drawn to conform to an ideal configuration. Ignoring superscripts, which are employed to distinguish one curve from another, the points A, B, M, C and D indicate corresponding reference points in the curves. A is the point beyond which additional exposure results in an increase in density—that is, A is the highest exposure level consistent with obtaining minimum density (Dmin). The curve segment A—B is in each instance the toe of the characteristic curve. In the toe of a characteristic curve incremental increases in density become larger with each incremental increase in exposure. The curve segments B—C are shown as linear—that is, as regions in which each incremental increase in exposure produces a corresponding incremental increase in density. In this region contrast or $\gamma$, the ratio of $\Delta D/\Delta \log E$, remains constant. In practice the mid-scale portion of a characteristic curve is rarely truly linear, and the $\Delta D/\Delta \log E$ interval used to calculate average contrast is usually based on characteristic curve points at arbitrarily selected low and high density values. The curve segment C—D is the shoulder of the characteristic curve. In this region each incremental increase in exposure produces a smaller increase in density than that which preceded. Exposure beyond point D produces no further increase in density. Therefore point D lies at maximum density (Dmax). The point M is the mid-scale point located at mid-scale density. Mid-scale density is determined from the relationship:

$$\frac{Dmax - Dmin}{2} + Dmin$$

DEFINITION OF TERMS

The term "double coated" as applied to a radiographic element means that emulsion layer units are coated on each of the two opposite sides of the support.

The term "low crossover" as applied to double coated radiographic elements indicates a crossover of less than 10% within the wavelength range and when measured as more fully described below.

The term "sensitometrically symmetric" means that the emulsion layer units on opposite sides of a double coated radiographic element produce identical characteristic curves when identically exposed.

The term "sensitometrically asymmetric" means that the emulsion layer units on opposite sides of a double coated radiographic element produce significantly different characteristic curves when identically exposed.

DESCRIPTION OF PREFERRED EMBODIMENTS

The present invention constitutes an improvement over low crossover double coated radiographic elements, such as, for example, those disclosed by Dickerson et al I and II, the disclosures of which are here incorporated by reference. The advantages of the present invention are that in addition to image sharpness attributable to low crossover the radiographic elements are also capable of producing useful images over a wide range of exposures and with different pairs of intensifying screens that vary widely in their relative light emissions. Thus, the invention provides a medical radiologist, for example, with a wide range of imaging capabilities using a single type of radiographic element. This imaging flexibility and adaptability of the radiographic elements of the invention allows fewer types of radiographic elements to be kept in stock while still meeting varied imaging needs. Additionally, the invention allows better resolution of imaging detail over a wide range of exposure levels, such as those encountered in medical radiography, for example, in attempting to simultaneously obtain information in high exposure density (e.g., lung) areas and low exposure density (e.g., media sternum) areas.

Figure 1:
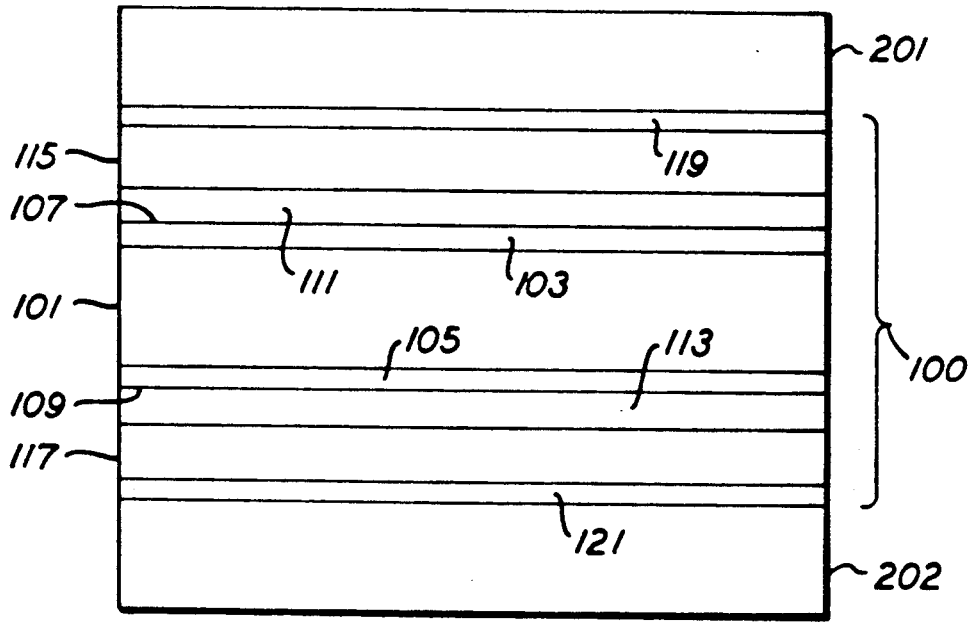
FIG. 1 is a schematic diagram of an assembly consisting of a low crossover radiographic element sandwiched between two intensifying screens.

The imaging characteristics of low crossover double coated radiographic elements can be appreciated by referring to FIG. 1. In the assembly shown a low crossover double coated radiographic element 100 is positioned between a pair of light emitting intensifying screens 201 and 202. The radiographic element support is comprised of a transparent radiographic support element 101, typically blue tinted, capable of transmitting light to which it is exposed and, optionally, similarly transmissive subbing units 103 and 105. On the first and second opposed major faces 107 and 109 of the support formed by the subbing units are crossover reducing hydrophilic colloid layers 111 and 113, respectively. Overlying the crossover reducing layers 111 and 113 are light recording latent image forming silver halide emulsion layer units 115 and 117, respectively. Each of the emulsion layer units is formed of one or more hydrophilic colloid layers including at least one silver halide emulsion layer. Overlying the emulsion layer units 115 and 117 are optional hydrophilic colloid protective overcoat layers 119 and 121, respectively. All of the hydrophilic colloid layers are permeable to processing solutions.

In use, the assembly is imagewise exposed to X-radiation. The X radiation is principally absorbed by the intensifying screens 201 and 202, which promptly emit light as a direct function of X-ray exposure. Considering first the light emitted by screen 201, the light recording latent image forming emulsion layer unit 115 is positioned adjacent this screen to receive the light which it emits. Because of the proximity of the screen 201 to the emulsion layer unit 115 only minimal light scattering occurs before latent image forming absorption occurs in this layer unit. Hence light emission from screen 201 forms a sharp image in emulsion layer unit 115.

However, not all of the light emitted by screen 201 is absorbed within emulsion layer unit 115. This remaining light, unless otherwise absorbed, will reach the remote emulsion layer unit 117, resulting in a highly unsharp image being formed in this remote emulsion layer unit. Both crossover reducing layers 111 and 113 are interposed between the screen 201 and the remote emulsion layer unit and are capable of intercepting and attenuating this remaining light. Both of these layers thereby contribute to reducing crossover exposure of emulsion layer unit 117 by the screen 201. In an exactly analogous manner the screen 202 produces a sharp image in emulsion layer unit 117, and the light absorbing layers 111 and 113 similarly reduce crossover exposure of the emulsion layer unit 115 by the screen 202.

Following exposure to produce a stored latent image, the radiographic element 100 is removed from association with the intensifying screens 210 and 202 and processed in a rapid access processor—that is, a processor, such as an RP-X-Omat TM processor, which is capable of producing a image bearing radiographic element dry to the touch in less than 90 seconds. Rapid access processors are illustrated by Barnes et al U.S. Pat. No. 3,545,971 and Akio et al published European published patent application 248,390.

As employed herein the term "low crossover" means reducing to less than 10 percent crossover of electromagnetic radiation of wavelengths longer than 300 nm capable of forming a latent image in the silver halide emulsion layer units. As indicated above, low crossover is achieved in part by absorption of light within the emulsion layer units and in part by the layers 111 and 113, which serve as crossover reducing means. In addition to having the capability of absorbing longer wavelength radiation during imagewise exposure of the emulsion layer units the crossover reducing means must also have the capability of being decolorized in less than 90 seconds during processing, so that no visual hindrance is presented to viewing the superimposed silver images.

The crossover reducing means decreases crossover to less than 10 percent, preferably reduces crossover to less than 5 percent, and optimally less than 3 percent. However, it must be kept in mind that for crossover measurement convenience the crossover percent being referred to also includes "false crossover", apparent crossover that is actually the product of direct X-radiation absorption. That is, even when crossover of longer wavelength radiation is entirely eliminated, measured crossover will still be in the range of 1 to 2 percent, attributable to the X-radiation that is directly absorbed by the emulsion farthest from the intensifying screen. Taking false crossover into account, it is apparent that any radiographic element that exhibits a measured crossover of less than about 5 percent is in fact a "zero crossover" radiographic element. Crossover percentages are determined by the procedures set forth in Abbott et al U.S. Pat. Nos. 4,425,425 and 4,425,426.

Once the exposure crossover between the emulsion layer units has been reduced to less than 10 percent (i.e., low crossover) the exposure response of an emulsion layer unit on one side of the support is influenced to only a slight extent by (i.e., essentially independent of) the level of exposure of the emulsion layer on the opposite side of the support. It is therefore possible to form two independent imaging records, one emulsion layer unit recording only the emission of the front intensifying screen and the remaining emulsion layer unit recording only the emission of the back intensifying screen during imagewise exposure to X radiation.

Historically radiographic elements have been constructed to produce identical sensitometric records in the two emulsion layer units on the opposite sides of the support. The reason for this is that until practical low crossover radiographic elements were made available by Dickerson et al I and II, cited above, both emulsion layer units of a double coated radiographic element received essentially similar exposures, since both emulsion layer units were simultaneously exposed by both the front and back intensifying screens.

To provide a specific illustration, consider the performance of the radiographic element 100 converted to a high crossover radiographic element by eliminating the crossover reducing layers 111 and 113. In this instance the emulsion layer units 115 and 117 are each exposed by both the intensifying screens 201 and 202. Referring to FIG. 2, a typical overall characteristic curve A—B—M—C—D is produced by exposing a high crossover double coated radiographic element. The overall characteristic curve is the sum of two identical characteristic curves A'—B'—M'—C'—D' produced by the individual emulsion layer units. The same individual characteristic curves are produced even when the front and back intensifying screens are varied in their emission intensities, since each emulsion layer unit is exposed by both intensifying screens and therefore receives essentially the same exposure.

Since image sharpness is not a feature that shows up in a characteristic curve, the same overall and individual emulsion layer unit characteristic curves can be produced by substituting a low crossover sensitometrically symmetric radiographic element, such as radiographic element 100 with identical emulsion layer units 115 and 117 and with the crossover reducing layers 111 and 113 present, provided front and back intensifying screens 201 and 202 having similar light emission properties are employed. Stated more generally, the assembly shown in FIG. 1 can produce two identical characteristic curves A'—B'—M'—C'—D' only when the photicity of intensifying screen 201 and the emulsion layer unit 115 together exhibit a photicity that matches that of the intensifying screen 202 and the emulsion layer unit 117 together.

When a low crossover double coated radiographic element is employed with a pair of intesifying screens, each intensifying screen exposes the adjacent emulsion layer unit independently of the the exposure occurring on the opposite side of the radiographic element. Thus two independent radiographic records are produced. The general relationship of interest, applicable to both symmetric and asymmetric low crossover double coated radiographic elements is the relationship of the photicity of the back screen-emulsion layer unit combination to the photicity of the front screen-emulsion layer unit combination. The photicity of each screen and the emulsion layer unit it exposes is the integrated product of (1) the total emission of the screen over the wavelength range to which the emulsion layer unit is responsive, (2) the sensitivity of the emulsion layer unit over this emission range, and the (3) the transmittance of radiation between the screen and its adjacent emulsion layer unit over this emission range. Transmittance is typically near unity and can in this instance be ignored. Photicity is discussed in greater detail in Mees, *The Theory of the Photographic Process*, 3rd. Ed., Macmillan, 1966, at page 462, here incorporated by reference.

It is the recognition of the inventors that by changing the photicity of the front screen-emulsion layer unit combination of a low crossover double coated radiographic element relative to the photicity of the back screen-emulsion layer unit combination the characteristic curve produced by the front emulsion layer unit can be shifted in relation to that produced by the back emulsion layer unit. When the two curves are integrated by superimposed viewing after processing, the relative shift in photicities results in an alteration of the overall characteristic curve produced. Thus, multiple screen combinations can be employed with a single low crossover double coated radiographic element to obtain a variety of different overall characteristic curves.

FIG. 3 illustrates an unsuccessful attempt to obtain extended exposure latitude using a sensitometrically symmetric low crossover double coated radiographic element in combination with a pair of intensifying screens of excessively differing light emission intensities as a function of X-radiation exposure level. The characteristic curve $A^1$—$B^1$—$M^1$—$C^1$—$D^1$ is identical to characteristic curve A'—B'—M'—C'—D' in FIG. 2. This is the characteristic curve produced by exposure of a first of the two emulsion layer units with a first, higher emission intensity screen. The second characteristic curve $A^2$—$B^2$—$M^2$—$C^2$—$D^2$ is produced by exposing the remaining or second emulsion layer unit on the opposite side of the support with a much lower emission intensity screen. For ease of description, the emulsion layer units on the opposite sides of the support can be considered to have identical sensitometric characteristics. The two individual sensitometric curves are not superimposed as in FIG. 2, since the log E scale is that of overall exposure and the intensifying screen which is solely responsible for exposing the second emulsion layer unit to produce characteristic curve $A^2$—$B^2$—$M^2$—$C^2$—$D^2$ does to emit light at the minimum level required to produce a latent image in the second emulsion layer unit until after the first intensifying screen has received sufficient X-radiation to emit light sufficient to expose the first emulsion layer unit beyond its maximum density level $D^1$.

When the two characteristic curves $A^1$—$B^1$—$M^1$—$C^1$—$D^1$ and $A^2$—$B^2$—$M^2$—$C^2$—$D^2$ are integrated an unacceptable overall characteristic curve $A^T$—$B^T$—$E^T$—$F^T$—$C^T$—$D^T$ is obtained offering more than twice the exposure latitude (Δlog E exposure range) from $B^T$ to $C^T$ as that offered by either emulsion layer unit individually—i.e., from $B^1$ to $C^1$ or from $B^2$ to $C^2$. The shortcoming of the overall characteristic curve $A^T$—$B^T$—$E^T$—$F^T$—$C^T$—$D^T$ lies in the $E^T$ to $F^T$ segment of the overall characteristic curve. Notice that in this region increasing exposure levels produce little or no observable differences in density. It is therefore impossible in this exposure region to distinguish visually two regions of a radiographic image produced by different exposure levels. For example, in terms of medical radiography, this results in a radiologist being unable to distinguish anatomical features differing in their X-radiation absorption characteristics that result in exposure levels in within the $E^T$ to $F^T$ range. Thus, the radiologist is working with a "blind spot" or, more accurately, a blind range in the middle of an otherwise useful exposure range. If the differences in the emission intensities of the front and back screens are increased, the range of exposures falling within the "blind spot" are increased and the anatomical features that can no longer be visually distinguished are increased.

While the foregoing discussion has been in terms of shifting the emission intensity of one screen relative to another, from the discussion of relative photicities above it is apparent that it is the difference in the photicities of the front screen-emulsion layer unit combination as compared to the back screen-emulsion layer unit combination that accounts for the relative shift in the individual characteristic curves. Thus, differences in the relative sensitivities of the front and back emulsion layer units alone or in combination with differences in front and back screen emissions can also account for an unacceptable overall characteristic curve as shown in FIG. 3.

It is the discovery of this invention that sensitometrically asymmetric low crossover radiographic elements capable of being employed with a wide variety of different intensifying screen pairs (including screen pairs differing widely in their emission intensities as a function of X-radiation exposure) and capable of providing visually discernible density differences over a wide range of overall exposures can be produced by properly selecting the contrasts of the emulsion layer units on opposite sides of the support. Specifically, it has been discovered that when one of the emulsion layer units has a relatively low average contrast (e.g., from 0.5 to <2.0) over an extended reference exposure range (e.g., at least 1.0 log E, preferably 1.5 log E and optimally 2.0 log E, where E is exposure measured in meter-candle-seconds), and the remaining emulsion layer unit on the opposite side of the support has a significantly higher contrast (e.g., a mid-scale contrast of at least 0.5 greater than the average contrast of the lower contrast emulsion layer unit) imaging advantages are realized and imaging difficulties, such as mid-exposure scale blind spots of the type noted above in connection with FIG. 3, can be avoided.

Referring to FIG. 4, a relatively low contrast first emulsion layer unit characteristic curve $A^L$—$B^L$—$C^L$—$D^L$ is shown in which the exposure of point $C^L$ exceeds that at point $B^L$ by at least the extended reference exposure range. When the difference in density ($\Delta D$) between points $C^L$ and $B^L$ is divided by the difference in exposure between these same two points ($\Delta$log E) an average contrast in the range of from 0.5 to <2.0, optimally from about 1.0 to 1.5, is obtained.

The second emulsion layer unit on the opposite side of the sensitometrically asymmetric low crossover radiographic element of the invention provides the individual characteristic curve $A^H$—$B^H$—$M^H$—$C^H$—$D^H$. The second emulsion layer unit exhibits a contrast higher than that of the first emulsion layer unit. At mid-scale point $M^H$ the second emulsion layer unit exhibits a contrast at least 0.5 higher than the average contrast of the first emulsion layer unit, preferably at least 1.0 higher than the average contrast of the first emulsion layer unit. The mid-scale density of the second emulsion layer unit is selected for comparison, since typically mid-scale contrast is either at or very near the highest contrast exhibited by a characteristic curve. The second emulsion layer unit preferably has a maximum contrast in the range of from 1.0 to 10, most preferably from 1.0 to 5, and optimally from 1.0 to 2.5. Limiting the maximum contrast on the higher contrast emulsion layer unit insures that it can contribute significantly to overall useful exposure latitude and, more importantly, provide a convenient exposure latitude for higher contrast imaging.

The overall characteristic curve $A^I$—$B^I$—$E^I$—$F^I$—$C^I$—$D^I$ is the integrated product of the two individual characteristic curves. Of particular interest in the overall characteristic curve is the segment extending between $E^I$ and $F^I$. Comparing the resultant characteristic curve with that observed in FIG. 3, note that unlike the $E^T$—$F^T$ curve segment there is no portion in the curve segment $E^I$—$F^I$ that exhibits zero contrast (i.e., a blind spot). Rather, the contrast progressively increases from that of the low contrast of curve segments $B^L$—$C^L$ and $B^I$—$C^I$ to the relatively higher contrast of curve segment $F^I$—$C^I$.

The resulting sensitometrically asymmetric low contrast radiographic element of the invention exhibiting the differences in emulsion layer unit contrasts noted above offers significant imaging advantages to a radiologist. First, because the radiographic element exhibits low crossover, sharp image definitions are attainable. Second, again because the radiographic element exhibits low crossover, it is possible for the radiologist to shift the position of the curve $A^H$—$B^H$—$M^H$—$C^H$—$D^H$ on the overall exposure scale relative to the curve $A^L$—$B^L$—$C^L$—$D^L$ and thereby vary the profile of the overall characteristic curve $A^I$—$B^I$—$E^I$—$F^I$—$C^I$—$D^I$ merely by selecting intensifying screen pairs of differing relative emission intensities for use with the radiogrpahic element. Since the lower contrast emulsion layer unit provides a useful exposure range of at least the extended reference exposure range (1.0 to 2.0 log E), whereas imaging exposure in lung areas is usually no more than about 1.0 log E greater than in heart areas, the radiologist is supplied with a dynamic range for relatively adjusting the exposures of the separate emulsion layer units that at least meets and in most instances exceeds diagnostic needs.

The radiologist has the capability by intensifying screen selection to shift the highest contrast segment of the characteristic curve $F^I$—$C^I$ to record exposure of the anatomical region where maximum contrast in desired. As shown in FIG. 4 the highest contrast segment $F^I$—$C^I$ of the characteristic curve is located in a higher exposure region. This allows the radiologist to achieve high contrast imaging in anatomical areas of low density to X-radiation (e.g., lung areas) while still having the eposure latitude to detect anomalies in higher density anatomical areas (e.g., heart areas). If the radiologist became interested in getting maximum contrast in areas of intermdiate density to X-radiation (e.g., lymph node areas), this can be achieved without changing the selection of the radiographic element merely by changing the selection of the intensifying screen employed to expose the higher contrast emulsion layer unit.

In the foregoing discussion of the higher and lower contrast emulsion layer units nothing has been said about their relative speeds. This is because their relative speeds can be widely varied. Since it is the photicity of the front screen-emulsion layer unit combination as compared to the photicity of the back screen emulsion layer unit combination that controls the relative location of the individual characteristic curves along the total exposure scale, it is appreciated that screen pairs can be selected to adjust relative photicities in any desired manner. It is alternatively conceivable, at least in theory, that a radiographic element manufacturer could supply a variety of radiographic elements intended to offer the same range of imaging capabilities described above to a radiologist working with only a very restricted number of screen pairs. In practice only a few radiographic elements differing in the relative speeds of the individual emulsion layer units and a few screen pairs differing in their relative emission intensities can produce a large array of differing imaging capabilities. By further considering reversal of front and back orientations of the radiographic element during exposure the number of possible imaging variations is doubled. It is generally preferred, but not required, that the lower contrast emulsion layer unit be employed with a front intensifying screen during exposure. It is also preferred, but not required, that the lower contrast emulsion layer unit have a speed ranging from 0 to 2.0 log E (optimally from about 0.5 to 1.5 log E) greater than that of the higher contrast emulsion layer unit.

The characteristic curve $A^L$—$B^L$—$C^L$—$D^L$ has been shown for simplicity of description in an ideal form with a linear characteristic curve extending between the toe at point $B^L$ and the shoulder at point $C^L$, which corresponds to an exposure range of at least the extended reference exposure range. Since this segment of the characteristic curve is linear, the point gammas of this segment are also uniform. The term "point gamma" is employed as defined by Mees, *The Theory of the Photographic Process*, 4th Ed. Macmillan, 1977, at page 502. It is the quotient of the differential density divided by the differential log E at a point on the characteristic curve.

Although emulsions can in theory be blended to satisfy almost any aim contrast, it is impractically tedious to blend emulsions to achieve invariant point gammas over an extended exposure range. It is therefore recognized that in practice the point gammas of the lower contrast emulsion layer unit over the extended reference exposure range will vary somewhat. The lower contrast emulsion layer units of the radiographic elements of this invention exhibit point gammas in the extended reference exposure range that differ from the average point gamma by less than ±40%, preferably less than ±20%. Although averaging point gammas requires no more than routine mathematical skills, a discussion of average point gamma determinations is illustrated by Kuwashima et al U.S. Pat. No. 4,792,518, the disclosure of which is here incorporated by reference.

Conventional double coated radiographic elements are sensitometrically symmetric. It is therefore customary to perform sensitometric measurements on the double coated element rather than on a single emulsion emulsion layer unit. To keep the sensitometric parameters of this invention comparable to customary measurements average and mid-scale contrasts and emulsion layer unit speeds are determined by coating the emulsion layer unit to be measured on both sides of a conventional transparent film support. This is done to allow those skilled in the art to compare readily the numerical parameters recited to those they customarily employ in characterizing double coated radiographic elements. In the various plots of density or point gamma versus log E for a particular emulsion layer unit each curve represents a single emulsion layer unit rather than a pair of identical emulsion layer units, since this permits the contribution of each emulsion layer unit to the overall characteristic curve to be more readily visually appreciated. Point gamma variance ranges were established from these curves.

Apart from the features noted above the radiographic elements of this invention can take any convenient conventional form. Features and details of features not specifically discussed preferably correspond to those disclosed by Dickerson et al I and II, cited and incorporated by reference above.

EXAMPLES

The invention can be better appreciated by reference to the following specific examples:

SCREENS

The following intensifying screens were employed:

SCREEN W

This screen has a composition and structure corresponding to that of a commercial, high speed screen. It consists of a terbium activated gadolinium oxysulfide phosphor having a median particle size of 8 to 9 μm coated on a white pigmented polyester support in a Permuthane TM polyurethane binder at a total phosphor coverage of 13.3 g/dm$^2$ at a phosphor to binder ratio of 19:1.

SCREEN X

This screen has a composition and structure corresponding to that of a commercial, general purpose screen. It consists of a terbium activated gadolinium oxysulfide phosphor having a median particle size of 7 μm coated on a white pigmented polyester support in a Permuthane TM polyurethane binder at a total phosphor coverage of 7.0 g/dm$^2$ at a phosphor to binder ratio of 15:1.

SCREEN Z

This screen has a composition and structure corresponding to that of a commercial, high resolution screen. It consists of a terbium activated gadolinium oxysulfide phosphor having a median particle size of 5 μm coated on a blue tinted clear polyester support in a Permuthane TM polyurethane binder at a total phosphor coverage of 3.4 g/dm$^2$ at a phosphor to binder ratio of 21:1 and containing 0.0015% carbon.

SCREEN EMISSIONS

The relative emissions of electromagnetic radiation longer than 370 nm in wavelength of the intensifying screens were determined as follows:

Screen W=625
Screen X=349
Screen Z=100

The screens exhibited no significant emissions at wavelengths between 300 and 370 nm.

The X-radiation response of each screen was obtained using a tungsten target X-ray source in an XRD 6 TM generator. The X-ray tube was operated at 70 kVp and 30 mA, and the X-radiation from the tube was filtered through 0.5 mm Cu and 1 mm Al filters before reaching the screen.

The emitted light was detected by a Princeton Applied Research model 1422/01 TM intensified diode array detector coupled to an Instruments SA model HR-320 TM grating spectrograph. This instrument was calibrated to within ±0.5 nm with a resolution of better than 2 nm (full width at half maximum). The intensity calibration was performed using two traceable National Bureau of Standards sources, which yielded an arbitrary intensity scale proportional to Watts/nm/cm$^2$. The total integrated emission intensity from 250 to 700 nm was calculated on a Princeton Applied Research model 1460 OMA III TM optical multichannel analyzer by adding all data points within this region and multiplying by the bandwidth of the region.

Actual emission levels were converted to relative emission levels by dividing the emission of each screen by the emission of Screen Z and multiplying by 100.

RADIOGRAPHIC EXPOSURES

Assemblies consisting of a double coated radiographic element sandwiched between a pair of intensifying screens were in each instance exposed as follows:

The assemblies were exposed to 70 KVp X-radiation, varying either current (mA) or time, using a 3-phase Picker Medical (Model VTX-650) TM X-ray unit containing filtration up to 3 mm of aluminum. Sensitometric gradations in exposure were achieved by using a 21-increment (0.1 log E) aluminum step wedge of varying thickness.

PROCESSING

The films were processed in 90 seconds in a commercially available Kodak RP X-Omat (Model 6B) TM rapid access processor as follows:

development 20 seconds at 35° C.,
fixing 12 seconds at 35° C.,
washing 8 seconds at 35° C., and
drying 20 seconds at 65° C., where the remaining time is taken up in transport between processing steps. The development step employs the following developer:

Hydroquinone 30 g
1-Phenyl-3-pyrazolidone 1.5 g
KOH 21 g
$NaHCO_3$ 705 g
$K_2SO_3$ 44.2 g
$Na_2S_2O_5$ 12.6 g
NaBr 35 g
5-Methylbenzotriazole 0.06 g
Glutaraldehyde 4.9 g Water to 1 liter at pH 10.0, and the fixing step employs the following fixing composition:

Ammonium thiosulfate, 60% 260.0 g
Sodium bisulfite 180.0 g
Boric acid 25.0 g
Acetic acid 10.0 g
Aluminum sulfate 8.0 g
Water to 1 liter at pH 3.9 to 4.5.

SENSITOMETRY

Optical densities are expressed in terms of diffuse density as measured by an X-rite Model 310 TM densitometer, which was calibrated to ANSI standard PH 2.19 and was traceable to a National Bureau of Standards calibration step tablet. The characteristic curve (density vs. log E) was plotted for each radiographic element processed. Average contrast in each instance was determined from the characteristic curve at densities of 0.25 and 2.0 above minimum density.

ELEMENT A (Example)

(Em.LC)LXOA(Em.HC)

Radiographic element A was a double coated radiographic element exhibiting near zero crossover.

Radiographic element A was constructed of a low crossover support composite (LXO) consisting of a blue-tinted transparent polyester film support coated on each side with a crossover reducing layer consisting of gelatin (1.6 g/m$^2$) containing 320 mg/m$^2$ of a 1:1 weight ratio mixture of microcrystalline crossver reducing Dyes 56 and 59 of Dickerson et al II.

Low contrast (LC) and high contrast (HC) emulsion layers were coated on opposite sides of the support over the crossover reducing layers. Both emulsions were green-sensitized high aspect ratio tabular grain silver bromide emulsions, where the term "high aspect ratio" is employed as defined by Abbott et al U.S. Pat. No. 4,425,425 to require that at least 50 percent of the total grain projected area be accounted for by tabular grains having a thickness of less than 0.3 μm and having an average aspect ratio of greater than 8:1. The low contrast emulsion was a 1:1 (silver ratio) blend of a first emulsion which exhibited an average grain diameter of 3.0 μm and an average grain thickness of 0.13 μm and a second emulsion which exhibited an average grain diameter of 1.2 μm and an average grain thickness of 0.13 μm. The high contrast emulsion exhibited an average grain diameter of 1.7 μm and an average grain thickness of 0.13 μm. The high contrast emulsion exhibited less polydispersity than the low contrast emulsion. Both the high and low contrast emulsions were spectrally sensitized with 400 mg/Ag mol of anhydro-5,5-dichloro-9-ethyl-3,3'-bis(3-sulfopropyl)oxacarbocyanine hydroxide, followed by 300 mg/Ag mol of potassium iodide. The emulsion layers were each coated with a silver coverage of 2.42 g/m$^2$ and a gelatin coverage of 3.22 g/m$^2$. Protective gelatin layers (0.69 g/m$^2$) were coated over the emulsion layers. Each of the gelatin containing layers were hardened with bis(vinylsulfonylmethyl) ether at 1% of the total gelatin.

When coated as described above, but symmetrically, with Emulsion LC coated on both sides of the support and Emulsion HC omitted, using a Screen X pair, Emulsion LC exhibited a relative log speed of 98 and an average contrast of 1.8. Similarly, Emulsion HC when coated symmetrically with Emulsion LC omitted exhibited a relative log speed of 85 and an average contrast of 3.0. The emulsions thus differed in average contrast by 1.2 while differing in speed by 13 relative log speed units (or 0.13 log E).

When Element A was tested for crossover as described by Abbott et al U.S. Pat. No. 4,425,425, it exhibited a crossover of 2%.

Figure 5:
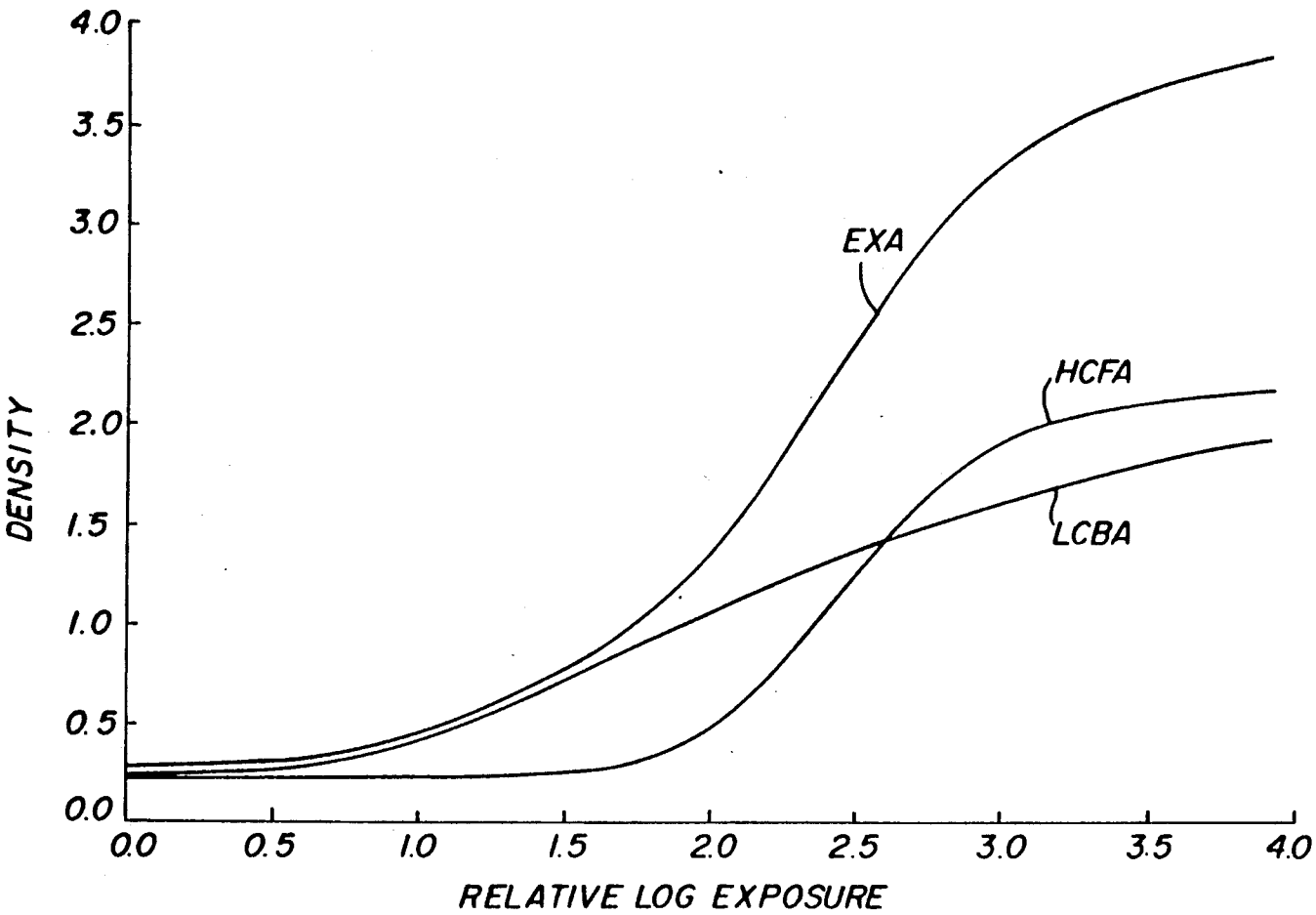
FIGS. 5 and 7 illustrate the overall and individual emulsion layer unit characteristic curves of example radiographic elements according to the invention.

When Emulsion HC of Element A was exposed by Screen Z employed as a front screen and Emulsion LC was exposed by Screen W employed as a back screen, the individual and combined characteristic curves shown in FIG. 5 were obtained, where HCFA designates the front screen-emulsion layer unit combination, LCBA designates the back screen-emulsion layer unit combination, and EXA designates the overall characteristic curve. Notice that even though the back screen was more than six times faster than the front screen there is no flat or even nearly flat (low contrast) region between the toe and shoulder portions of the overall characteristic curve EXA. The overall characteristic curve EXA has a useful imaging range of at least 2.0 log E.

Figure 6:
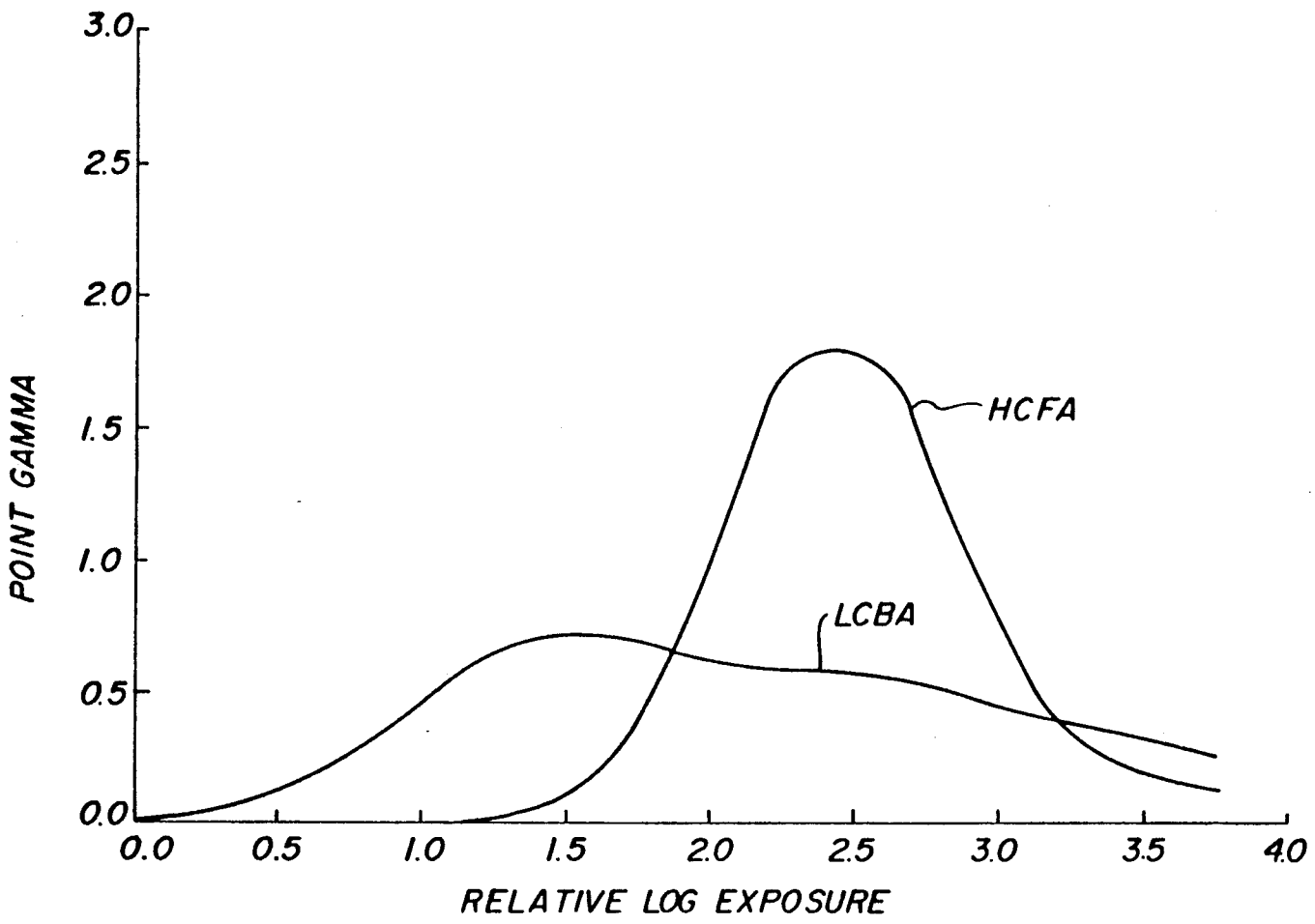
FIGS. 6 and 8 illustrate plots of point gamma versus relative log exposure.

An important feature to notice is the very limited variance in the contrast of the characteristic curve LCBA. This can be better appreciated by reference to FIG. 6, which plots point gamma versus log E. Over the 2.0 log E range of from 1.0 to 3.0 the point gamma ranges from 0.7 to 0.49, an average point gamma of 0.595, with point gamma variances of ±18%. Over the 1.0 log E range of from 2.0 to 3.0 the point gamma average is 0.57, with point gamma variances of ±14%. The point gamma variance curve HCFA is included in FIG. 6 to show by comparison how unusually low the point gamma variances are for LCBA.

Because of the low point gamma variances of the low contrast emulsion layer unit it is clear that any combination of the screens W, X and Z with either the low contrast emulsion layer unit employed as the front or back layer unit during exposure is capable of yielding useful characteristic curves. Further, because the radiographic element exhibits low crossover, each screen pair and radiographic element orientation makes available to the radiologist a significantly different overall characteristic curve.

ELEMENT B (Example)

(Em.FLC)LXOB(Em.SHC)

Radiographic element B was a double coated radiographic element exhibiting near zero crossover.

Radiographic element B was constructed of a low crossover support composite (LXO) identical to that of element A, described above.

Fast low contrast (FLC) and slow high contrast (SHC) emulsion layers were coated on opposite sides of the support over the crossover reducing layers. Emulsion FLC was identical to emulsion LC in element A while emulsion SHC was identical to emulsion HC in element A, except that the tabular grains had an average diameter of a 1.0 μm and an average thickness of 0.13 μm. Both emulsions were chemically and spectrally sensitized and coated similarly as the emulsion layers of element A.

When coated symmetrically, with Emulsion FLC coated on both sides of the support and Emulsion SHC omitted, using a Screen X pair, Emulsion FLC exhibited a relative log speed of 113 and an average contrast of 1.98. Similarly, Emulsion SHC when coated symmetrically with Emulsion FLC omitted exhibited a relative log speed of 69 and an average contrast of 2.61. The emulsions thus differed in average contrast by 0.63 while differing in speed by 44 relative log speed units (or 0.44 log E).

When Element B was tested for crossover as described by Abbott et al U.S. Pat. No. 4,425,425, it exhibited a crossover of 2%.

Figure 7:
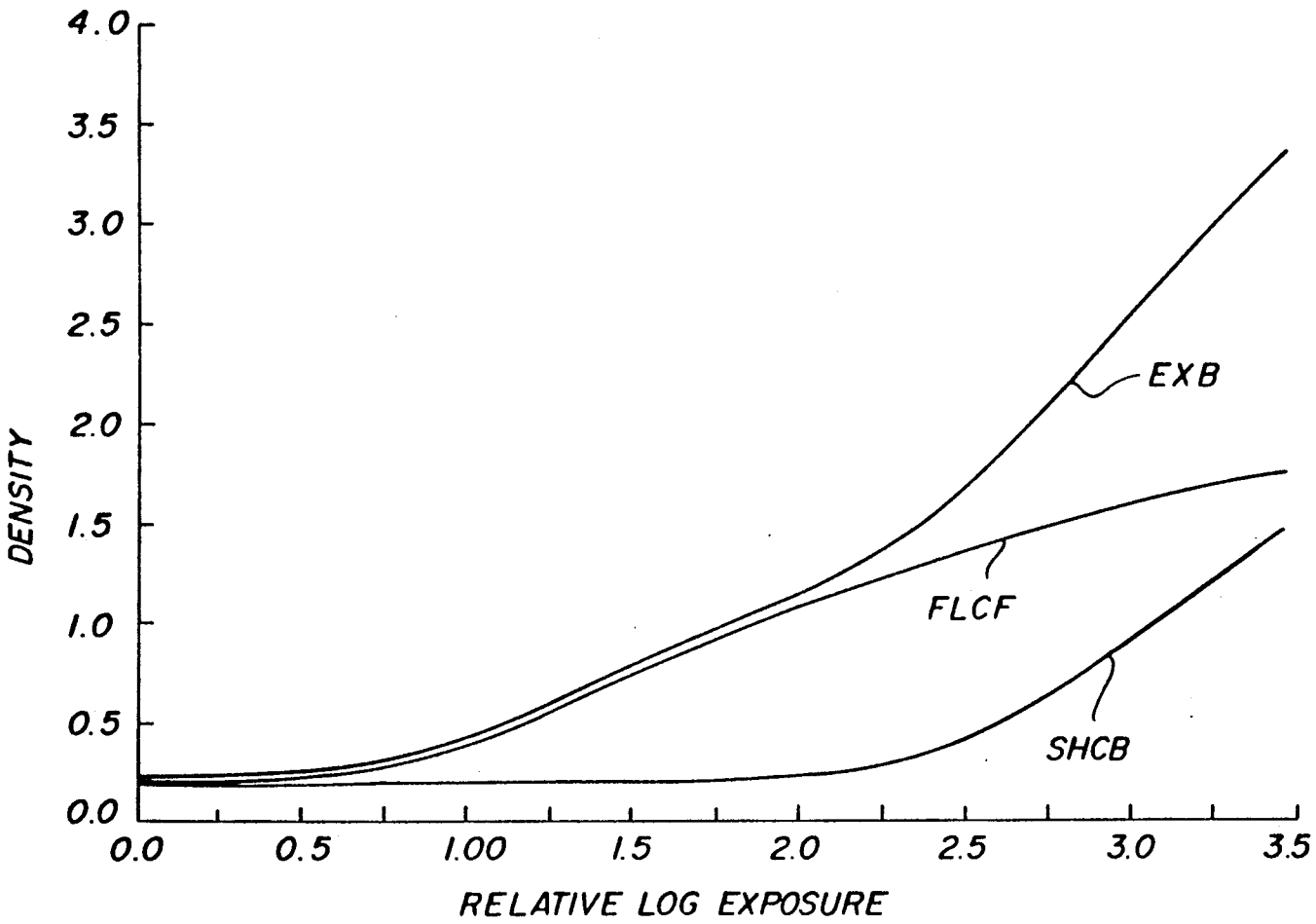

When Emulsion FLC of Element B was exposed by Screen Z employed as a front screen and Emulsion SHC was exposed by Screen X employed as a back screen, the individual and combined characteristic curves shown in FIG. 7 were obtained, where FLCF designates the front screen-emulsion layer unit combination, SHCB designates the back screen-emulsion layer unit combination, and EXB designates the overall characteristic curve. There is no flat or even nearly flat (low contrast) region between the toe and shoulder portions of the overall characteristic curve EXB. The overall characteristic curve EXB has a useful imaging range of at least 2.5 log E, with an average contrast of 2.5. When Element B was reversed in its orientation so that the fast low contrast emulsion FLC was positioned adjacent the back screen, Screen X, the average contrast was reduced to 1.5 and an extremely long exposure latitude was obtained well in excess of 3.0 log E. Had the radiographic element exhibited high crossover, very difference, if any, in the overall characteristic curve would have resulted from reversing the orientation of the radiographic element between the pair of intensifying screens.

Figure 8:
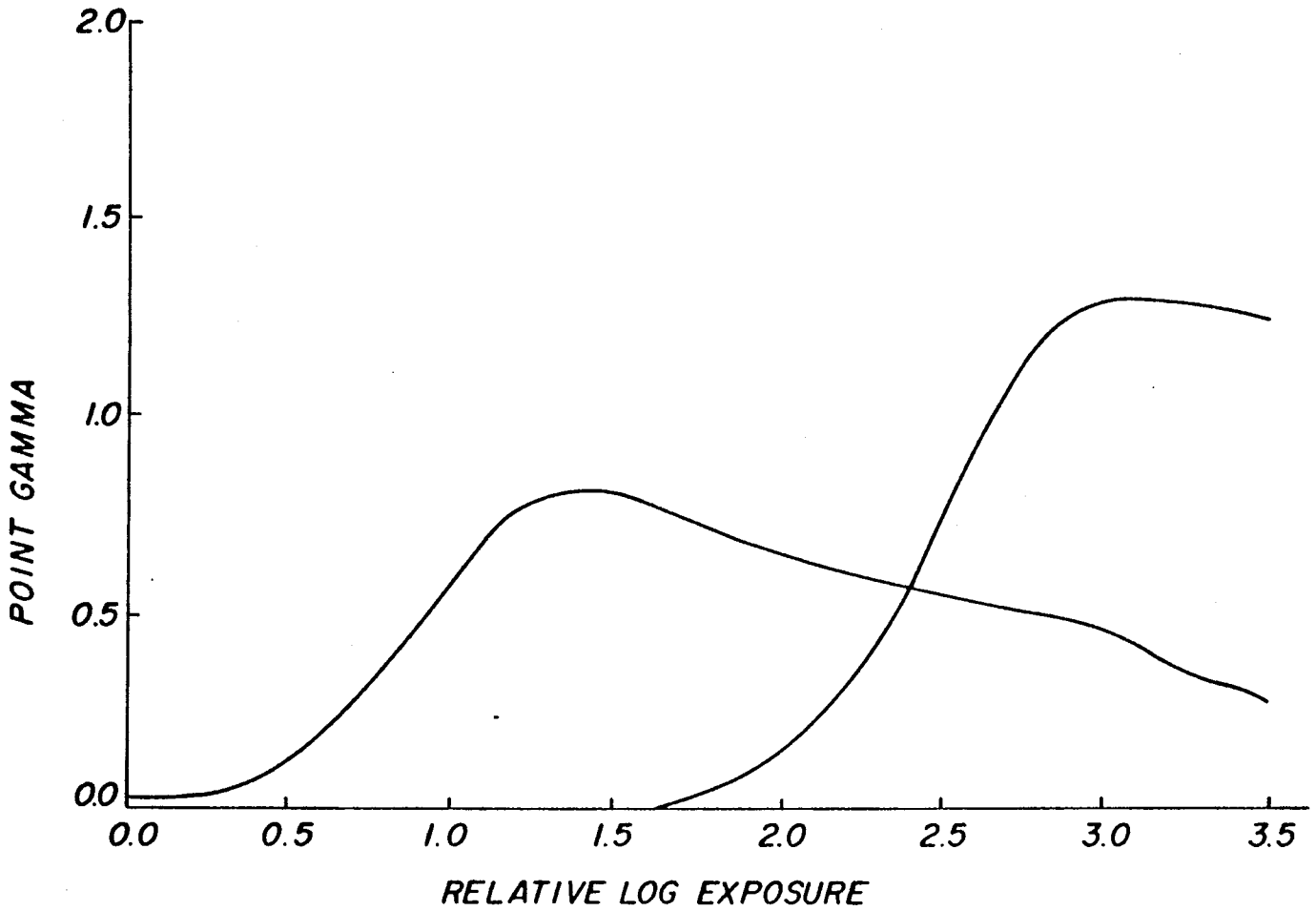

Again, the limited variance in the contrast of the characteristic curve FLCF is significant. Referring to FIG. 8, which plots point gamma versus log E, over the 1.0 log E range of from 2.0 to 3.0 the point gamma variance is ±15%.

Because of the low point gamma variances of the low contrast emulsion layer unit it is clear that any combination of the screens W, X and Z with either the low contrast emulsion layer unit employed as the front or back layer unit during exposure is capable of yielding useful characteristic curves. Further, because the radiographic element exhibits low crossover, each screen pair and radiographic element orientation makes available to the radiologist a significantly different overall characteristic curve.

The invention has been described in detail with particular reference to preferred embodiments thereof, but it will be understood that variations and modifications can be effected within the spirit and scope of the invention.

What is claimed is:

1. A radiographic element comprised of a transparent film support, first and second silver halide emulsion layer units coated on opposite sides of the film support, and means for reducing to less than 10 percent crossover of electromagnetic radiation of wavelengths longer than 300 nm capable of forming a latent image in the silver halide emulsion layer units, said crossover reducing means being decolorized in less than 30 seconds during processing of said emulsion layer units, characterized in that said first silver halide emulsion layer unit over an exposure range of at least 1.0 log E exhibits an average contrast of from 0.5 to <2.0 and point gammas that differ from the average contrast by less than ±40% and said second silver halide emulsion layer unit exhibits a mid-scale contrast of at least 0.5 greater than the average contrast of said first silver halide emulsion layer unit, the average contrast of the first silver halide emulsion layer unit being determined with the first silver halide emulsion unit replacing the second silver halide emulsion unit to provide an arrangement with the first silver halide emulsion unit present on both sides of the transparent support and the mid-scale contrast of the second silver halide emulsion layer unit being determined with the second silver halide emulsion unit replacing the first silver halide emulsion unit to provide an arrangement with the second silver halide emulsion layer unit present on both sides of the transparent support.

2. A radiographic element according to claim 1 further characterized in that said second silver halide emulsion layer unit exhibits a mid-scale contrast of least 1.0.

3. A radiographic element according to claim 1 further characterized in that said second silver halide emulsion layer unit exhibits a maximum contrast in the range of from 1.0 to 10.

4. A radiographic element according to claim 3 further characterized in that said second silver halide emulsion layer unit exhibits a maximum contrast in the range of from 1.0 to 5.0.

5. A radiographic element according to claim 4 further characterized in that said second silver halide emulsion layer unit exhibits a maximum contrast in the range of from 1.0 to 2.5.

6. A radiographic element according to claim 1 further characterized in that said point gammas of said first silver halide emulsion layer unit differ by ±20%.

7. A radiographic element according to claim 1 further characterized in that said crossover reducing means decreases crossover to less than 5 percent.

8. A radiographic element according to claim 7 further characterized in that said crossover reducing means decreases crossover to less than 3 percent.

9. A radiographic element according to claim 1 further characterized in that the first silver halide emulsion layer unit exhibits a faster speed than that of the second silver halide emulsion layer unit.

* * * * *